US005805016A

United States Patent [19]

Jiang

[11] Patent Number: 5,805,016

[45] Date of Patent: Sep. 8, 1998

[54] VARIABLE CAPACITOR BASED ON FREQUENCY OF OPERATION

[75] Inventor: Chongjun Jiang, Dallas, Tex.

[73] Assignee: Advanced Micro Devices, Sunnyvale, Calif.

[21] Appl. No.: 812,632

[22] Filed: Mar. 7, 1997

[51] Int. Cl.[6] ..... G05F 3/16

[52] U.S. Cl. ..... 327/565; 327/553; 327/379; 326/27; 365/149; 365/206

[58] Field of Search ..... 365/149, 226, 365/206; 326/27; 327/393, 394, 379, 276, 553, 565

[56] References Cited

U.S. PATENT DOCUMENTS 5,247,241 9/1993 Sharpe-Geisler ..... 327/379

5,544,102 8/1996 Tobita et al. ..... 365/226

*Primary Examiner*—Vu A. Le

*Attorney, Agent, or Firm*—Rita M. Wisor

[57] ABSTRACT

A variable capacitor for integrated circuits used as a decoupling capacitor that operates at both low and high frequencies is disclosed. Based upon a programmable input signal, the decoupling capacitance of the circuit varies within a specific range providing a vehicle for testing decoupling capacitance requirements of new integrated circuits and functions and new silicon processes. The programmable input signal switches a transistor from the saturated region of operation to the unsaturated region of operation, varying the decoupling capacitance of the transistor. By providing circuitry to control the switching of the transistor, the circuit operates at both low and high frequencies, reducing the negative impacts of transistor channel resistance during high frequency operation.

14 Claims, 5 Drawing Sheets

VARIABLE CAPACITOR BASED ON FREQUENCY OF OPERATION

BACKGROUND OF THE INVENTION

1. Field of the Invention

This invention relates to the field of variable capacitors for integrated circuits.

2. Background

High frequency operation of semiconductor chips, such as the high speed microprocessors found in today's personal computers, causes the switching of many circuits. The switching of many circuits at one time results in extraneous electrical signals known as noise. Noise may cause erratic and unreliable circuit behavior. Prevention of noise is typically accomplished by providing capacitors between Vcc (power) and Vss (ground). Capacitors connected in this way are known as decoupling capacitors. Semiconductor chips may include multiple decoupling capacitors in parallel to increase the decoupling capability.

The amount of decoupling capability required to reduce noise significantly varies based on the frequency of the switching of the circuits, the number of switching circuits and the technology or silicon process used. Using too many capacitors on a semiconductor chip is undesirable since capacitors typically utilize large amounts of silicon area. However, using too few capacitors does not provide enough noise protection, thereby causing erratic and unreliable circuit behavior.

Therefore, when a new process or a new circuit is developed, the optimum amount of decoupling capacitance must be determined for each desired frequency of operation. Typically, the optimum amount of capacitance is determined by utilizing a test chip with variable or programmable capacitors. By varying the capacitance with programmable inputs on the test chip and testing the results, the optimum decoupling capacitance can be determined per semiconductor chip or new silicon process. The determined optimum amount of decoupling capacitance is then implemented in production chips for the given frequency of operation.

Typically, transistors are connected together between power and ground to form decoupling capacitors in semiconductor chips. FIG. 1 is a diagram of the physical structure of an n-channel MOSFET (Metal Oxide Semiconductor Field-Effect Transistor), hereafter referred to as an NMOS transistor, according to a preferred embodiment of the present invention. An NMOS transistor is formed on a p-type silicon substrate. Two heavily doped n+ wells with metal contacts form the source node (S) and the drain node (D). The gate node (G) is insulated from the silicon by a thin oxide layer.

The substrate node (B) of an NMOS transistor is usually connected to the most negative point in the circuit to ensure the drain and source wells remain reverse biased to ensure that negligible current flows through the junction. If Vgs (Voltage as measured from gate to source) is equal to zero, no current flows since the path from drain to source is effectively two series diodes back to back. With no current flowing, the transistor is OFF.

When Vds (Voltage as measured from drain to source) is small, to cause current to flow from drain to source, thereby turning the transistor ON, a channel must be formed by applying a positive voltage Vgs. A positive voltage at the gate attracts electrons from the substrate and causes them to accumulate at the surface beneath the oxide layer. In order for current to flow, the voltage Vgs has to become equal to or greater than a threshold voltage Vt. Vt is dependent on silicon process technology used. For NMOS transistors, Vt is a positive voltage.

When Vgs is increased greater than Vt, the channel widens as more electrons are attracted from the wells into the region just beneath the oxide. The channel resistance decreases. Here, the transistor is operating in what is known as the triode region, also known as the unsaturated region. Electrons flow from the source to the drain. Current is defined to flow from the drain to the source.

When a transistor has current flow, it is said to be ON. When no current flows, it is OFF. When a transistor is ON, it has a gate to channel capacitance. If the gate node of the transistor is connected to Vcc and other nodes of the transistor are connected to Vss, the transistor acts as a decoupling capacitor. Connecting many transistors in this manner increases the decoupling capacitance of the circuit.

FIG. 2 shows a typical transistor circuit used as a low frequency programmable decoupling capacitor. In this example, both transistors, T1 and T2, are NMOS transistors such as the NMOS transistor shown in FIG. 1. A programmable input, DEN1, is connected to the gate node of transistor T1. DEN1 transitions from logic one (approximately 3–5 volts, based on the technology used, but greater than Vt) to logic zero (approximately zero volts and less than Vt). The drain node of T1 is connected to Vcc (power) and the source node of T1 is connected to the gate node of T2. The substrate nodes of T1 and T2 are connected to Vss (ground). The source node and drain node of T2 are connected to Vss.

T1 is used as a switch connecting and disconnecting T2 to Vcc. T2 has gate to channel capacitance and acts as a decoupling capacitor between Vcc and Vss when connected through T1 to Vcc. When DEN1 is equal to logic zero, Vgs for both T1 and T2 is approximately zero volts and no current flows. Both T1 and T2 are OFF. T2 is no longer connected to Vcc through T1 and therefore has no decoupling capability.

When DEN1 is equal to logic one, Vgs for T1 is greater than Vt and a channel is created in T1 causing current to flow from drain to source (T1 is ON). When T1 is ON, T2 is connected to Vcc through T1 and acts as a decoupling capacitor. At low frequencies, T2 has fill gate to channel capacitance. The programmable input DEN1 is used to turn the circuit's decoupling capacitance ON and OFF.

As the frequency is increased, the channel resistance of T1 becomes a limiting factor for the capacitor performance. The channel resistance of T1 causes exponential charging and discharging of the circuit capacitors. The cycle period of noise must be larger than the RC constant (resistance-capacitance time constant) of the circuit or reduced amounts of current flows through T1 causing the decoupling capability of T2 to decrease. As frequency increases, current takes more time to flow from the capacitor. When the frequency is very high, T2 has no decoupling capability at all.

For low frequency applications, the transistor circuit of FIG. 2 operates as a programmable decoupling capacitor. When the cycle period of the noise is smaller than the RC constant of the circuit, the circuit fails to operate as a decoupling capacitor.

As silicon processes improve, integrated circuits are operating at higher and higher frequencies. These higher frequencies cause high frequency noise. Decoupling capacitor circuits as shown in FIG. 2 are not effective at these higher frequencies. A capacitor circuit is needed that operates at both low and high frequencies. Low frequency operation is needed to test basic circuit operation when building and manufacturing a semiconductor chip, and high frequency operation is needed for actual operating frequencies. For new silicon processes and new circuit designs, a capacitor circuit needs to be programmable to give the ability to determine the optimum amounts of capacitance required to decouple noise.

SUMMARY OF THE INVENTION

The present invention is a variable capacitor based on frequency of operation. At both low and high frequencies, the decoupling capability of the capacitor varies from higher to lower capacitance values, controlled by a programmable input signal. At low frequencies, the decoupling capacitance of the circuit switches from full to ⅔ decoupling capacitance capability by switching the programmable input signal. At high frequencies, the decoupling capacitance of the circuit switches from ½ to ⅔ decoupling capacitance capability by switching the programmable input signal.

The decoupling capacitor is preferably implemented in CMOS technology using two NMOS transistors and a PMOS transistor. The PMOS transistor and one NMOS transistor operate with the programmable input signal to selectively switch the second NMOS transistor from the unsaturated to saturated regions of operation. At low frequencies, the decoupling capability switches with the programmable input from full gate to channel capacitance of the second NMOS transistor operating in the unsaturated region of operation, to ⅔ gate to channel capacitance of the second NMOS transistor operating in the saturated region of operation. At high frequencies, the decoupling capability switches with the programmable input from ½ gate to channel capacitance of the second NMOS transistor operating in the unsaturated region of operation, to ⅔ gate to channel capacitance of the second NMOS transistor operating in the saturated region of operation.

The present invention provides a programmable capacitor that does not lose its effectiveness at high frequencies. The programmable capacitor provides switchable capacitance values at both low and high frequencies.

A further understanding of the nature and advantages of the present invention may be realized by reference to the remaining portions of the specification and the drawings.

BRIEF DESCRIPTION OF THE DRAWINGS

So that the manner in which the above recited advantages and features of the present invention, as well as others which will become apparent, are attained and can be understood in detail, a more particular description of the invention summarized above had by reference to the embodiment thereof which is illustrated in the appended drawings, which drawings form a part of this specification. It is to be noted, however, that the appended drawings illustrate only typical embodiments of the invention and are therefore not to be considered limiting of its scope, for the invention may admit to other equally effective embodiments.

DETAILED DESCRIPTION OF PREFERRED EMBODIMENTS

Figure 3:
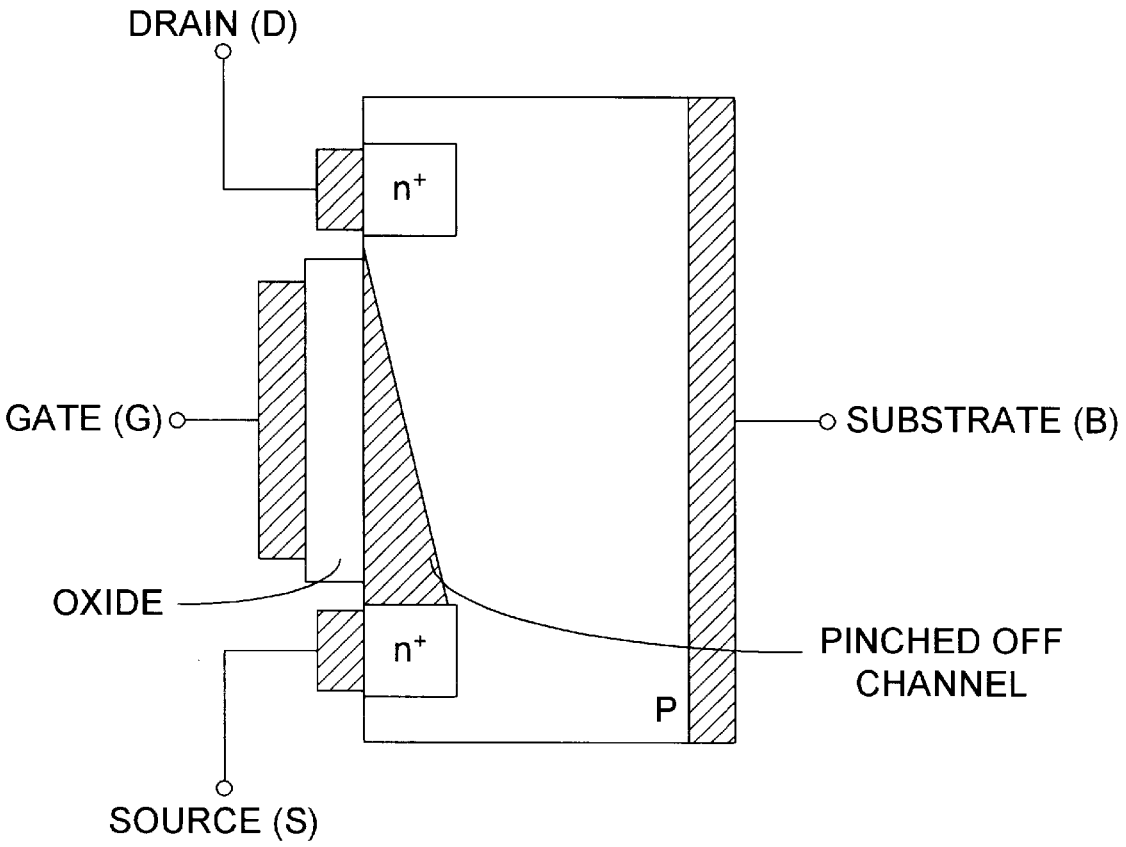
FIG. 3 is a diagram of the physical structure of an NMOS transistor operating in the Pinch-Off region according to a preferred embodiment of the present invention.

FIG. 3 is a diagram of the physical structure of an NMOS transistor operating in the Pinch Off region according to a preferred embodiment of the present invention. As shown, when Vgs is greater than Vt and Vds is increased, the channel becomes narrower at the drain end. The density of the channel electrons near the drain is diminished with increased Vds. As Vds increases, the channel resistance increases as the channel begins to taper at the drain end. When Vgd (Voltage as measured from gate to drain) is less than or equal to Vt, the channel width becomes zero at the drain end. Here, the transistor is operating in the Pinch Off region, also known as the saturated region. Current still flows, but with increased Vds, the current flow remains approximately constant.

In summary, the voltage relationships are shown below:

Unsaturated region: $Vgs-Vt>Vds$

Saturated region: $Vds>Vgs-Vt$

The operation of the p-channel MOSFET, hereafter referred to as a PMOS transistor, parallels that of the NMOS transistor. The characteristics are similar except for a reversal of polarity of all currents and voltages. Vt for the PMOS transistor is a negative voltage.

Figure 4:
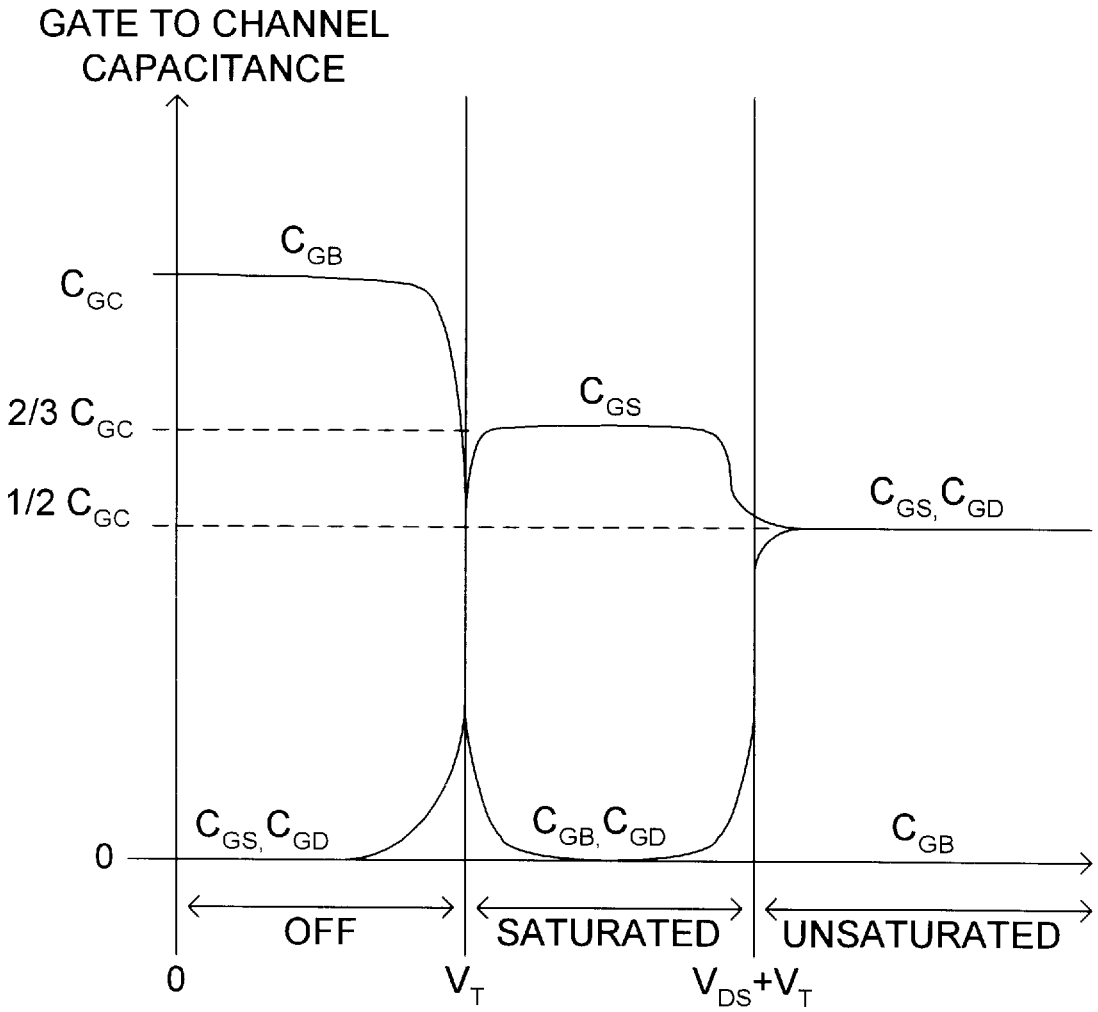
FIG. 4 is a graph showing Gate to Channel Capacitance versus Vgs relationship for Cgs, Cgd, and Cgb (capacitance from gate to source, drain and substrate, respectively) according to a preferred embodiment of the present invention.

FIG. 4 is a graph showing Gate to Channel Capacitance versus Vgs relationship for Cgs, Cgd, and Cgb (capacitance from gate to source, drain and substrate, respectively) according to a preferred embodiment of the present invention. Total Gate to Channel Capacitance is approximately the sum of Cgs, Cgd, and Cgb. Overlap capacitances due to an overlap of two conducting surfaces separated by a dielectric, such as the gate to source, drain and substrate capacitances, are not shown in FIG. 4. These overlap capacitances do not vary as a function of Vgs and only add a small constant capacitance to the overall circuit.

When the transistor is off, the Gate to Channel Capacitance is the full value available, contributed from the Gate to Substrate capacitance. The value of the capacitance is dependent on the technology used and the sizing of the individual components of the transistor.

In the saturated region of operation, the drain side of the channel is pinched off With the drain pinched off, the gate capacitance is reduced. In saturation, the Gate to Channel capacitance is approximately ⅔ of the full value and is contributed by the gate to source capacitance. No capacitance is contributed by the gate to drain nor the gate to substrate.

In the non-saturated region of operation, the channel extends from the source to the drain and the gate to channel capacitance is simply divided evenly between Cgd and Cgs. With no pinch off the gate capacitance is at its full value, one half capacitance contributed by the gate to drain and the other half by the gate to source.

Under ideal operating conditions, such as low frequency operation, the capacitance in the saturated region is ⅔ the capacitance in the unsaturated region. The capacitance in the saturated region is full gate to channel capacitance available.

Figure 5:
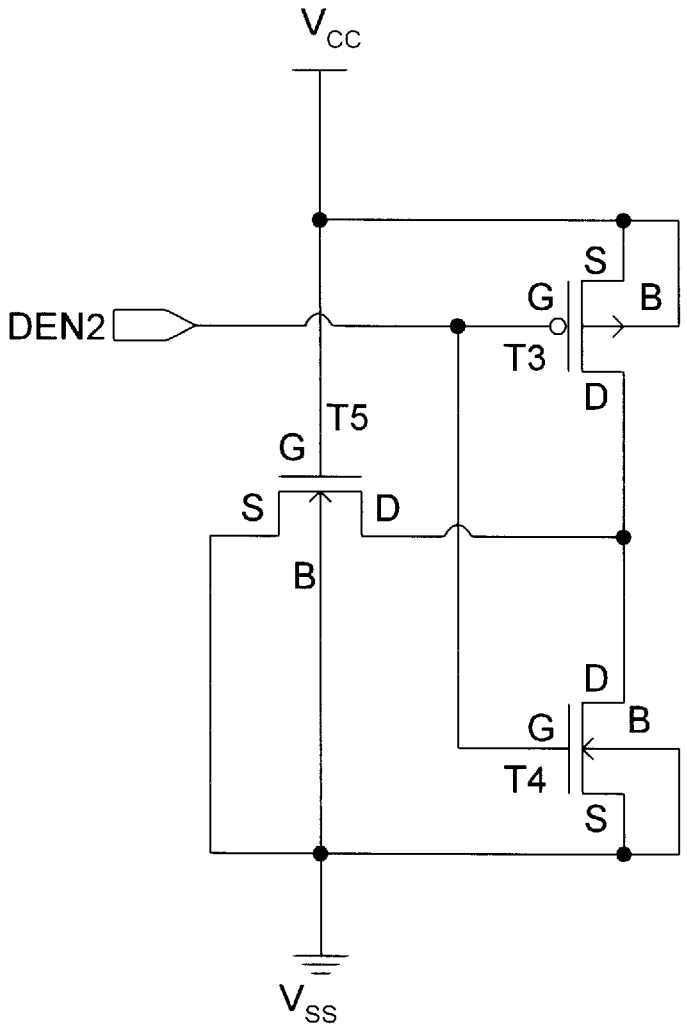
FIG. 5 shows a preferred embodiment of a variable capacitor circuit that remains effective at high frequencies.

FIG. 5 shows a preferred embodiment of a variable capacitor that remains effective at high frequencies. The capacitor circuit preferably has two NMOS transistors and one PMOS transistor. Combinations of NMOS and PMOS transistors are found in CMOS (Complementary-Symmetry MOS) technology. This capacitor provides programmable decoupling capacitance levels at both high and low frequencies. At low frequencies, the decoupling capability of the circuit switches from full to ⅔ gate to channel capacitance of T5 as the programmable input signal DEN2 switches. At high frequencies, the decoupling capability of the circuit switches from ½ to ⅔ gate to channel capacitance of T5 as the programmable input signal DEN2 switches.

In the preferred embodiment, the programmable input signal DEN2 is connected to the gate nodes of the PMOS transistor T3 and the first NMOS transistor T4. The substrate node and the source node of T3 are connected to Vcc. The drain node of T3 is connected to the drain node of T4. The substrate node and the source node of T4 are connected to Vss. The drain node of T5 is connected to the drain nodes of T3 and T4. The gate node of T5 is connected to Vcc. The substrate node and the source node of T5 are connected to Vss. NMOS transistor T5 operates as a decoupling capacitor from Vcc to Vss. PMOS transistor T3, NMOS transistor T4 and the programmable input DEN2 are used to vary the decoupling capability of T5.

The programmable input signal DEN2 manipulates the operation of T3 and T4, switching T5 between the saturated and unsaturated regions of operation. When DEN2 is equal to logic one, T3 is OFF and T4 is ON. The current flowing in T4 pulls the drain nodes of T3, T4 and T5 low (approximately equal to Vss). With the drain node of T5 low, Vds for T5 is approximately equal to zero volts, placing T5 in the unsaturated region of operation. At low frequencies, total capacitance is from the gate to source (½ channel capacitance) and from the gate to drain (½ channel capacitance). The gate to substrate has little channel capacitance in this region of operation. Under ideal operating conditions, such as low frequency operation, the decoupling capacitance is the full gate to channel capacitance of transistor T5.

When DEN2 is equal to logic zero, T4 is OFF and T3 is ON. The current flowing in T3 pulls the drain nodes of T3, T4 and T5 high (approximately equal to Vcc). With the drain node of T5 high, Vg of T5 is approximately equal to Vd of T5, making Vds equal to Vgs and placing T5 in the saturated region of operation. At low frequencies, total capacitance is from the gate to source (⅔ channel capacitance). The gate to substrate and gate to drain has no channel capacitance in this region of operation.

By changing the operation of T5 from the saturated to unsaturated regions of operation, the effective capacitance of the circuit is changed. When T5 operates in the unsaturated region of operation, at low frequencies the effective decoupling capacitance is full decoupling capacitance capability. When T5 operates in the saturated region of operation, at low frequencies the effective decoupling capacitance is ⅔ of full gate to channel capacitance of T5. Under ideal operating conditions, the capacitance in the saturated region of operation is equal to ⅔ the capacitance in the unsaturated region of operation.

At low frequencies, the decoupling capacitor behaves in the ideal region. At high frequencies, the ON and OFF states of T3, T4 and T5 is the same as for low frequency operation. However, at high frequencies a transistor's internal resistances affect high frequency response and must be considered when determining decoupling capacitance of a circuit.

Therefore, at higher frequencies, part of the capacitance seen at T5 is diminished by the resistance from the drain node of T5 to ground when in the unsaturated region of operation. This resistance is the T4 channel resistance when T4 is ON. At high frequencies in the unsaturated region the gate capacitance is reduced to ½ gate to channel capacitance due to the effects of the RC constant on the operation of T4.

Figure 1:
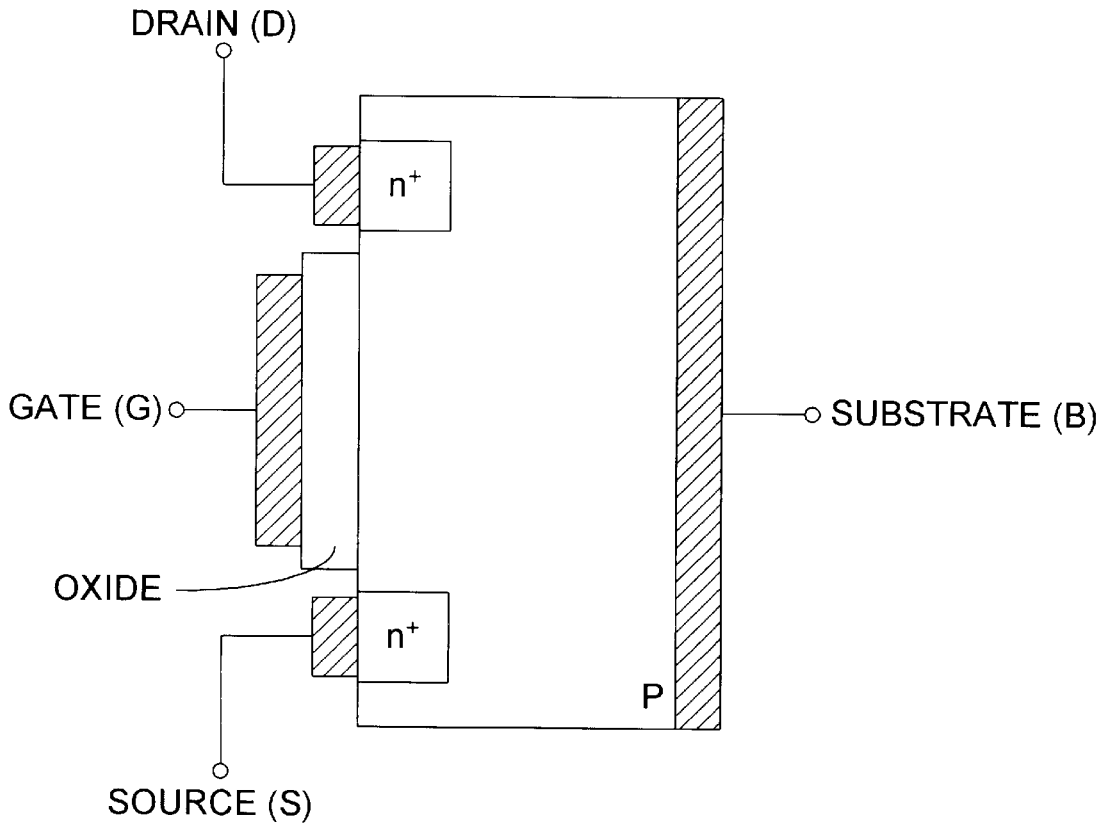
FIG. 1 is a diagram of the physical structure of an NMOS transistor according to a preferred embodiment of the present invention.
Figure 2:
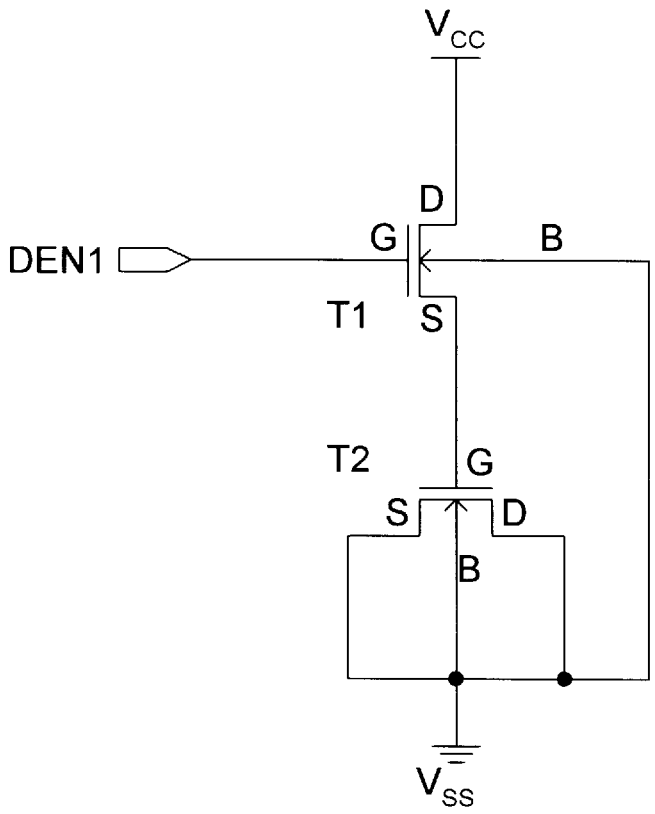
FIG. 2 (PRIOR ART)
FIG. 2, prior art, shows a low frequency programmable decoupling capacitor circuit.

Whereas the prior art circuit of FIG. 2 had its decoupling capability reduced to zero by higher frequencies, in the unsaturated region of operation the drain to source resistances of the parallel NMOS transistors of the present invention reduce the effects of the channel resistance in half (two equal parallel resistances reduce the overall resistance by ½), thereby lowering the RC constant of the circuit.

In the saturated region of operation, at high frequencies T4 is off and does not reduce the gate to channel capacitance. Therefore, the decoupling capacitance of T5 is the ideal ⅔ gate to channel capacitance in the saturated region, even during high frequency operation.

The preferred embodiment of the invention reduces the impact of the channel resistance in half since only half of the capacitance is affected by the channel resistance when it is in the unsaturated region. Reducing the impact of the channel resistance is desirable since when the frequency of the noise is faster than the RC constant of the circuit, the circuit fails to operate as a decoupling capacitor. At low frequencies the capacitor is able to switch between its full value and ⅔ of its full value. At high frequencies, the capacitor is able to switch between ⅔ of its full value and ½ of its full value. The ability to switch between varying levels of capacitance provides enough programmability to effectively determine the optimum levels of needed decoupling capacitance for integrated circuits.

In summary, the decoupling capacitance for the preferred embodiment of the present invention is shown in the following table.

| State of Input Signal | Region of Operation | Low Frequency Operation | High Frequency Operation |
|---|---|---|---|
| DEN=1 | Unsaturated | FULL | ½ FULL |
| DEN=0 | Saturated | ⅔ FULL | ⅔ FULL |

A variable capacitor is provided that remains programmable and operates at both low and high frequencies. By providing many of the described capacitor circuits in parallel and individually programming each circuit, the optimum amount of decoupling capacitance may be determined for the desired frequencies of circuit operation. By providing combinations of the variable capacitors, the decoupling capacitance differences between the saturated and unsaturated regions of operation are enhanced.

The programmable input DEN2 is used to vary the circuit's decoupling capacitance. Test chips can be formed with many programmable decoupling capacitor circuits. By enabling a large number of these decoupling circuits, significant decoupling capability is available. By selectively enabling these circuits, the decoupling capability can be varied and tested for given functions, silicon process technologies and differing frequencies.

In alternate embodiments of the present invention, various other circuits may be used in place of the programmable input signal DEN2, PMOS transistor T3 and NMOS transistor T4 to provide the switching function. For example, circuitry may be added to switch the decoupling capacitor through three regions of operation: full off, saturated and unsaturated.

In another alternate embodiment of the present invention, alternate transistors may be used in place of T5, for example a PMOS transistor that is switched from the saturated to unsaturated region of operation. This would provide alternate variable capacitor circuits that function at different voltages and with different processes.

Although the preferred embodiment of the invention is described as being used for determining the optimum decoupling capacitance capability in test chips for new processes and new integrated circuits, many alternate uses of the variable capacitor will be apparent to those of ordinary skill in the art.

Although the present invention has been fully described above with reference to specific embodiments, other alternative embodiments will be apparent to those of ordinary skill in the art. Therefore, the above description should not be taken as limiting the scope of the present invention which is defined by the appended claims.

What is claimed is:

1. A variable capacitor circuit comprising:

(a) a first transistor capable of operating in the saturated and unsaturated regions of operation; and (b) a means for switching said first transistor between the saturated and unsaturated regions of operation, thereby providing a plurality of capacitances.

2. The variable capacitor circuit of claim 1, wherein said means for switching comprises:

(a) a programmable input signal;

(b) a second transistor having a gate node connected to said programmable input signal, and a source node connected to Vcc;

(c) a third transistor having a gate node connected to said programmable input signal, a source node connected to Vss, and a drain node connected to the drain node of said second transistor.

3. The variable capacitor circuit of claim 2, wherein said first transistor capable of operating in the saturated and unsaturated regions of operation includes said first transistor having a gate node connected to Vcc, a source node connected to Vss, and a drain node connected to the drain node of said second transistor.

4. The variable capacitor circuit of claim 3, wherein said first transistor is an NMOS transistor, said second transistor is a PMOS transistor, and said third transistor is an NMOS transistor.

5. The variable capacitor circuit of claim 3, wherein when said programmable input signal transitions between logic one and logic zero, said first transistor switches between the unsaturated and saturated regions of operation.

6. The variable capacitor circuit of claim 3, wherein the effect of high frequencies on the channel resistance of said first transistor is reduced in half by said third transistor in parallel with said first transistor.

7. The variable capacitor circuit of claim 1, wherein said first transistor acts as a programmable decoupling capacitor.

8. The variable capacitor circuit of claim 7, wherein the decoupling capacitance of the circuit varies from full to ⅔ gate to channel capacitance of said first transistor at low frequencies.

9. The variable capacitor circuit of claim 7, wherein the decoupling capacitance of the circuit varies from ⅔ to ½ gate to channel capacitance of said first transistor at high frequencies.

10. The variable capacitor circuit of claim 1, further comprising an integrated circuit device utilizing a plurality of said variable capacitor circuits.

11. The variable capacitor circuit of claim 10 wherein the plurality of said variable capacitor circuits are individually programmable.

12. A method of providing a variable capacitance comprising the steps of:

(a) connecting a transistor between power and ground to form a decoupling capacitor;

(b) connecting a plurality of transistors to form a switch controlling the decoupling capacitor;

(c) switching the transistor forming a decoupling capacitor between the saturated and unsaturated regions of operation to provide programmable capacitance at both high and low frequencies.

13. The method of providing a variable capacitance of claim 12, wherein said step of switching the transistor from the unsaturated to saturated region of operation provides programmable capacitance of full to ⅔ gate to channel capacitance of the transistor at low frequencies.

14. The method of providing a variable capacitance of claim 12, wherein said step of switching the transistor from the saturated to unsaturated region of operation provides programmable capacitance of ⅔ to ½ gate to channel capacitance of the transistor at high frequencies.

* * * * *